United States Patent [19]

Conrad et al.

[11] Patent Number: 4,640,256

[45] Date of Patent: Feb. 3, 1987

[54] INTERNAL COMBUSTION ENGINE EXHAUST GAS RECYCLING ARRANGEMENT

[75] Inventors: Ulrich Conrad, Ludwigsburg; Peter Moser, Weinstadt; Gerhard Gruber, Backnang, all of Fed. Rep. of Germany

[73] Assignee: Daimler-Benz Aktiengesellschaft, Fed. Rep. of Germany

[21] Appl. No.: 627,666

[22] Filed: Jul. 3, 1984

[30] Foreign Application Priority Data

Jul. 6, 1983 [DE] Fed. Rep. of Germany ..... 3324343

[51] Int. Cl.[4] ..... F02M 25/06

[52] U.S. Cl. ..... 123/568; 123/52 M

[58] Field of Search ..... 123/568, 590, 52 M, 123/52 MV, 52 MB

[56] References Cited

U.S. PATENT DOCUMENTS

| | | | |
|---|---|---|---|
| 4,249,374 | 2/1981 | Sugasawa et al. | 123/568 X |
| 4,294,220 | 10/1981 | Yasuhara et al. | 123/568 |
| 4,327,698 | 5/1982 | Hamai et al. | 123/568 |
| 4,461,150 | 7/1984 | Grohn | 123/568 X |

FOREIGN PATENT DOCUMENTS

| | | |
|---|---|---|
| 1751655 | 7/1968 | Fed. Rep. of Germany . |
| 2702160 | 1/1977 | Fed. Rep. of Germany . |
| 2851180 | 11/1978 | Fed. Rep. of Germany . |
| 3227072 | 7/1982 | Fed. Rep. of Germany . |

*Primary Examiner*—Willis R. Wolfe, Jr.

*Attorney, Agent, or Firm*—Barnes & Thornburg

[57] ABSTRACT

An air guide casing includes an air filter, an air throttle valve, an exhaust gas recycling pipe, a mixing chamber in fluid communication with the recycling pipe, and a distributor chamber in fluid communication with the mixing chamber and at least one cylinder of an internal combustion engine. The air guide casing is provided with means for collecting a mixture of recycled exhaust gas and filtered intake air and means for distributing that mixture to the cylinders. Thus, the air guide casing provides a separate mixing section in the air guide casing to achieve good mixing of the air for combustion with the incoming exhaust gas prior to introduction of the exhaust gas and clean air into the distributor chamber.

11 Claims, 3 Drawing Figures

INTERNAL COMBUSTION ENGINE EXHAUST GAS RECYCLING ARRANGEMENT

BACKGROUND AND SUMMARY OF THE INVENTION

The invention relates to a multicylinder fuel injection internal combustion engine equipped with exhaust gas recycling. Particularly, the invention relates to an air guide casing for collecting a mixture of recycled exhaust gas and filtered intake air and distributing that mixture to the cylinders of the engine for combustion.

It is known to feed recycled exhaust gas into a current of air for combustion in order to achieve a better quality of exhaust gas in multicylinder internal combustion engines under certain operating conditions. German Unexamined Published Application (DE-OS) No. 29 47 940 discloses a system comprising an exhaust gas recycling pipe connected to the air inlet pipe at a point downstream of an air throttle valve leading to the internal combustion engine. The exhaust gas recycling pipe contains an exhaust gas recycling valve for controlling the exhaust gases.

In addition, it is known from German Unexamined Published Application (DE-OS) No. 28 51 180 to provide an exhaust gas recycling pipe leading into the air inlet pipe at a position downstream of an air throttle valve. The air inlet pipe conducts the air for combustion after such air has been treated by an air filter. An exhaust gas recycling valve is mounted in the air inlet pipe to regulate the flow of recycled exhaust gas thereinto.

The arrangement according to German Unexamined Published Application (DE-OS) No. 28 51 180 contains an air inlet pipe having an air filter disposed in an air guide casing, an air throttle valve, and an exhaust gas recycling valve. The exhaust gas recycling valve is situated in the air inlet pipe to be downstream of the air throttle valve. The air inlet pipe is an ordinary flow duct. A short mixing section lies between the recycling valve and the induction branch pipes leading to the individual cylinders of the internal combustion engine. This short mixing section is not sufficient for obtaining an almost homogeneous mixture of air and exhaust gas. Good distribution of the mixture to the individual cylinders is not achieved with the pipe arrangement used here.

One object of the present invention is to provide an air inlet pipe of compact contruction for a multicylinder internal combustion engine which will permit good mixing of the exhaust gas with the air for combustion and permit uniform distribution of the mixture of exhaust gas and air to the individual engine cylinders.

According to the present invention, a box-shaped air guide casing includes an air filter, an air throttle valve, a mixing section or chamber, and a distributor space or chamber. An exhaust gas recycling valve is disposed in an exhaust gas recycling pipe. The present invention provides a separate mixing section in the air guide casing to achieve good mixing of the air for combustion with the incoming exhaust gas prior to introduction of the exhaust gas and clean air into the distributor chamber. This novel feature advantageously causes an almost homogeneous mixture of air and exhaust gas to be uniformly distributed to the individual cylinders of the internal combustion engine. Furthermore, through the separation of the clean air side of the air guide casing from the mixing section and the distributor space, the air filter is protected against excessively high exhaust gas temperatures, while the soiling of the air filter by the exhaust gases is substantially reduced.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
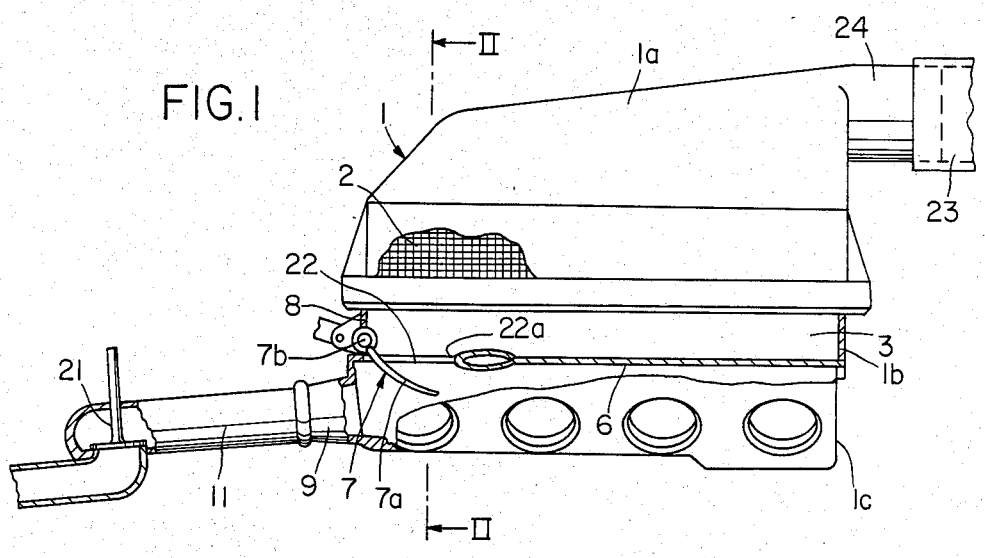
FIG. 1 is a side elevation schematic part-sectional view of a compact air guide casing constructed according to a preferred embodiment of the present invention with portions broken away.

A compact air guide casing 1 is made in box form and is adaptable for use with a four-cylinder fuel injection internal combustion engine with exhaust gas recycling. According to FIGS. 1 and 2, the air guide casing 1 is constructed in three parts, the upper casing part 1*a* (FIG. 1) containing an air filter 2, the middle casing part 1*b* downstream of the air filter 2 constituting the clean air chamber 3, and the bottom casing part 1*c* having a mixing duct 4 and a distributor duct 5. The upper casing 1*a* provides a cover for air filter 2.

The middle casing part 1*b* and the bottom casing part 1*c* are fastened together by clamping a partition 6 therebetween. The partition 6 contains an air throttle valve 7 by which the clean air chamber 3 is connected to the mixing duct 4.

The throttle valve 7 is disposed close to the exhaust gas inlet on the casing wall 8 of the middle casing part 1*b*. The throttle valve 7 is formed by a pivotally mounted throttle flap 7*a*, whose pivot pin 7*b* lies in the casing wall 8. Through the arrangement of the throttle valve 7 the exhaust gas recycle rate can be increased.

Figure 3:
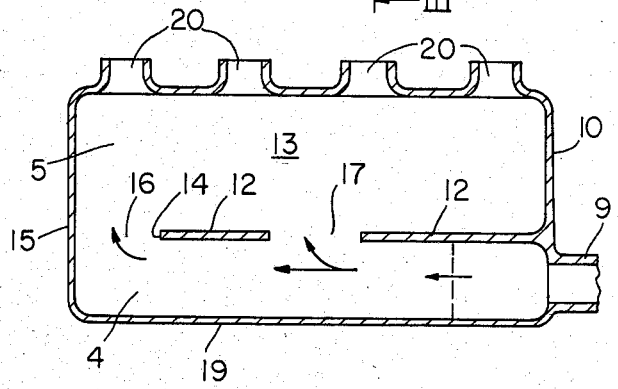
FIG. 3 is a transverse cross sectional view taken along line III—III in FIG. 2, schematically showing the recycled exhaust gas flowing into the mixing chamber and a mixture of exhaust gas and filtered air flowing into the distributor chamber for conduction to the engine cylinders for combustion.

The mixing duct 4 is connected by a connection 9 on the casing wall 10 of the bottom casing part 1*c*, below the throttle valve 7 (FIG. 1), to an exhaust gas recycling pipe 11. A wall 12 (FIG. 3) bounding the mixing duct 4 and extending from the bottom 13 of the casing part 1*c* to the partition 6 is disposed in the bottom casing part 1*c*. The wall 12 provides a mixing duct wall and extends from the casing wall 10 to an end 14. Wall end 14 cooperates with a casing wall 15 lying opposite the wall 10 to provide an overflow cross-sectional opening 16. The mixing duct wall 12 has another overflow cross-sectional opening 17 to improve the distribution of the mixture of air and exhaust gas. Opening 17 lies upstream of the overflow cross-sectional opening 16. The opening 17 is centrally located in relation to the length of the bottom casing part 1*c*.

The distributor duct 5 is situated adjacent to the mixing duct 4. Distributor duct 5 is connected by induction pipes 18 (FIG. 2) to corresponding cylinders of the internal combustion engine.

The connection points 20 (FIG. 3) formed in the longitudinal wall 19 of the bottom casing part 1*c* are intended for the induction pipes 18.

Figure 2:
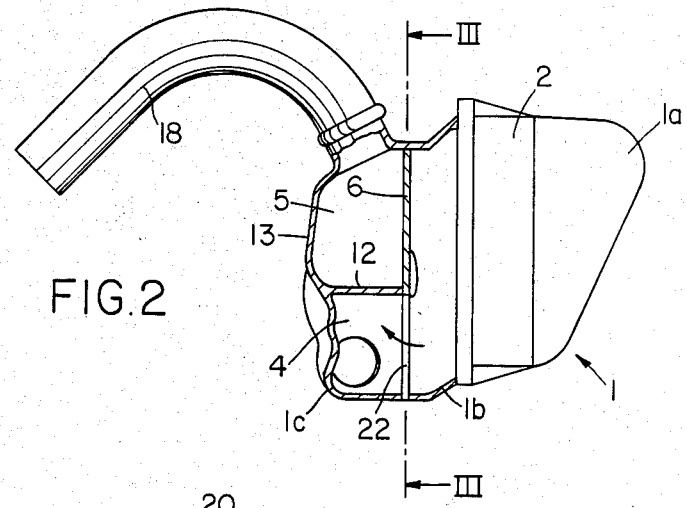
FIG. 2 is a transverse cross sectional view taken along line II—II of FIG. 1 and rotated 90°.

An exhaust gas recycling valve 21 is disposed in the exhaust gas recycling pipe 11, as shown in FIG. 1. A passage opening 22 is formed in partition 6 to permit operation of the air throttle valve 7. The partition edge 22*a* is provided with shaped portions which promote flow to control the recycled exhaust gas to improve the passage of the air for combustion from the clean air chamber 3 to the mixing duct 4. The shaped portions may for example have a drop-like shape (FIG. 1) towards the edges 22*a* when viewed in cross-section.

When the engine is turning or running, air for combustion flows through the induction hose 23 via the intake 24 into the cover 1*a*, flows through the air filter 2 and passes into the clean air side of the middle casing part 1*b*, flows from there by way of the air throttle valve 7 into the mixing duct 4, and is mixed with the exhaust gas in the mixing section when exhaust gas is recycled. The homogeneous mixture of air and exhaust gas passes into the distributor duct 5 by way of the passage openings 16, 17.

Through the special construction of the air guide casing 1 with integral mixing duct and distributor system, uniform distribution of the mixture of air and exhaust gas to the individual cylinders of the four-cylinder internal combustion engine is achieved.

Air guide casings of this or similar type can also be used for internal combustion engines having a smaller or larger number of cylinders.

Although the invention has been described in detail with reference to certain preferred embodiments and specific examples, variations and modifications exist within the scope and spirit of the invention as described and defined in the following claims.

What is claimed is:

1. An air guide casing for use on a multicylinder fuel injection internal combustion engine equipped with an exhaust pipe, an exhaust gas recycling pipe for conducting recycled exhaust gas, the recycling pipe being connected to the exhaust pipe, an air filter for treating air combustion, a clean air chamber for conducting treated air for combustion, an air throttle valve for throttling treated air being conducted by the clean air chamber, the recycling pipe being in fluid comunication with a mixing duct positioned downstream of the air throttle valve by operation of an exhaust gas recycling valve to permit recycled exhaust gas to be conducted from the exhaust pipe into the mixing duct via the recycling pipe to cause the recycled exhaust gas to be mixed with a quantity of treated air for combustion being conducted therethrough, the air guide casing comprising:

a distribution duct for conducting the mixture of recycled exhaust gas and treated air for combustion, a partition situated within the air guide casing to divide the air guide casing into a first portion including the clean air chamber and a second portion including the mixing duct and the distribution duct, the distribution duct being coupled to the mixing duct and in communication with at least one cylinder in the internal combustion engine, means for mounting the air throttle valve on the partition, wherein the partition includes a shaped lip portion in proximity to an opening between the clean air chamber and the mixing duct, the shaped lip portion having a drop-like shape when viewed in cross section to improve air flow through opening.

2. In a multicylinder internal combustion engine equipped with an air guide casing including filter means for treating intake air for combustion received therein, and recycling means for conducting exhaust gas produced by operation of the engine to the air guide casing for recombustion, the improvement comprising:

partition means for dividing the air guide casing into a first chamber including the filter means and a second chamber in fluid communication with the first chamber, the second chamber including mixing duct means for mixing a quantity of treated intake air with a quantity of recycled exhaust gas and distribution duct means for conducting the mixture of treated intake air and recycled exhaust gas, the distribution duct means being in fluid communication with the mixing duct means and at least one cylinder in the engine, wherein the mixing duct means and the distribution duct means share a common wall formed to include at least one aperture therethrough to permit the mixture of treated air and exhaust gas to travel from the mixing duct means into the distribution duct means for distribution to the at least one engine cylinder, the at least one aperture being continuously opened at all times to communicate the mixture of treated air and exhaust gas from the mixing duct means into the distribution duct means, said engine being a four-cylinder engine, and said distribution duct means being continuously in communication with inlet channels of all four engine cylidners.

3. An air guide casing for use on a multicylinder fuel injection internal combustion engine equipped with an exhaust pipe, an exhaust gas recycling pipe for conducting recycled exhaust gas, the recycling pipe being connected to the exhaust pipe, an air filter for treating air for combustion, a clean air chamber for conducting treated air for combustion, an air throttle valve for throttling treated air being conducted by the clean air chamber, the recycling pipe being in fluid communcation with a mixing duct positioned downstream of the air throttle valve by operation of an exhaust gas recycling valve to permit recycled exhaust gas to be conducted from the exhaust pipe into the mixing duct via the recycling pipe to cause the recycled exhaust gas to be mixed with a quantity of treated air for combustion being conducted therethrough, the air guide casing comprising:

a distribution duct for conducting the mixture of recycled exhaust gas and treated air for combustion, a partition situated within the air guide casing to divide the air guide casing into a first portion including the clean air chamber and a second portion including the mixing duct and the distribution duct, the distribution duct being coupled to the mixing duct and in communication with at least one cylinder in the internal combustion engine, means for mounting the air throttle valve on the partition, a bottom wall, a side wall formed to include an aperture to permit the recycling pipe to introduce recycled exhaust gas into the air guide casing therethrough, the air throttle valve being disposed in proximity to the recycling pipe aperture in the air guide casing, and an elongated mixing duct wall for separating the mixing duct and the distributor duct, the elongated mixing duct wall being attached along its length to the bottom wall and to the partition, the elongated mixing duct wall including a first end attached to the side wall of the air guide casing in close proximity to the recycling pipe aperture, the elongated mixing duct wall being formed to include at least one opening to permit the mixture of recycled exhaust gas and treated air for combustion to pass into the distribution duct therethrough.

4. The air guide casing of claim 3, wherein the elongated mixing duct wall further includes a second end situated in spaced relation to an opposite side wall of the air guide casing to provide an opening therebetween.

5. The air guide casing of claim 3, wherein the elongated mixing duct wall is formed to further include a second opening intermediate the first opening and said first end of the mixing duct wall.

6. An air inlet guide casing arrangement for a multicylinder internal combustion engine of the type having exhaust gas recycling, comprising:

a first casing portion defining a clean air accommodating space for accommodating clean air to be supplied as combustion air to an engine, said first casing portion including clean air inlet means for communicating clean air thereto, a second casing portion located separate from and downstream of said clean air accommodating space and being in communication with a recycling exhaust gas inlet means, said second casing portion defining a mixing chamber for accommodating mixing of the clean air from the clean air accommodating space and engine recirculated exhaust gases from the recycling exhaust gas inlet means, and a third casing portion disposed downstream of the mixing chamber and forming a distribution chamber for accommodating distribution of the mixed air from the mixing chamber as combustion inlet air to the cylinders of the combustion engine, wherein said first and second casing portions are separated by a common casing partition wall, and wherein air throttle valve means are provided in said common partition wall for controlling the flow of clean air to said mixing chamber.

7. An arrangement according to claim 6, wherein the first and second casing portions are configured to communicate all of the clean air to the engine cylinders by way of the mixing chamber.

8. An arrangement according to claim 6, wherein said second and third casing portions are separated by a second common partition wall, said second common partition wall including overflow opening means communicating with the distribution chamber.

9. An arrangement according to claim 8, wherein the second common partition wall overflow opening means are fixed opening apertures through said second common partition wall.

10. An arrangement according to claim 6, wherein said distribution chamber is in direct communication with all of the cylinders of the engine.

11. An arrangement according to claim 10, further comprising recycling exhaust control valve disposed upstream of the mixing chamber for controlling the supply of recycled exhaust gases to the mixing chamber.

* * * * *